United States Patent [19]

Kawabata et al.

[11] Patent Number: 4,921,019

[45] Date of Patent: May 1, 1990

[54] WEFT INSERTION IN JET LOOM

[75] Inventors: Susumu Kawabata, Aichi; Kazunori Yoshida, Nagoya; Fujio Suzuki, Toyota, all of Japan

[73] Assignee: Kabushiki Kaisha Toyota Chuo Kenkyusho, Aichi, Japan

[21] Appl. No.: 347,434

[22] Filed: May 2, 1989

[30] Foreign Application Priority Data

May 2, 1988 [JP] Japan ..... 63-107608

[51] Int. Cl.[5] ..... D03D 47/34; D03D 47/12

[52] U.S. Cl. ..... 139/452

[58] Field of Search ..... 139/452, 435

[56] References Cited

U.S. PATENT DOCUMENTS

| | | | |
|---|---|---|---|
| 3,580,444 | 5/1972 | Van Mullekom | 139/452 |
| 3,865,149 | 2/1975 | Keldany | 139/452 |
| 4,000,762 | 1/1977 | Mizuno | 139/452 |
| 4,479,518 | 10/1984 | Kiwior | 139/452 X |

FOREIGN PATENT DOCUMENTS

| | | |
|---|---|---|
| 38-21811 | 11/1963 | Japan . |
| 50-13976 | 6/1975 | Japan . |
| 61-201051 | 9/1986 | Japan . |

*Primary Examiner*—Andrew M. Falik

*Attorney, Agent, or Firm*—Oblon, Spivak, McClelland, Maier & Neustadt

[57] ABSTRACT

A jet loom comprising a weft measuring roller for continuously drawing out a weft from a supply package, a weft storage unit for temporarily accumulating and storing the weft drawn out from the supply package by the weft measuring roller, a main nozzle for jetting air to insert the weft into the warp shed, and a driving unit for sinusoidally varying the rotating speed of the weft measuring roller. The weft stored in the weft storage unit runs in a free running period in a free running mode at a comparatively high running speed. After the stored weft has exhausted, the weft is supplied for insertion directly from the weft measuring roller, so that the weft runs in a constrained running mode at a running speed constrained by the surface speed of the weft measuring roller. When the running mode of the inserted weft changes from the free running mode to the constrained running mode, the driving unit drives the weft measuring roller so that the surface speed of the weft measuring roller is higher than a speed Vf defined by: $Vf = Lo/tc$, where Lo is the weft length of the loom and tc is a time necessary for one weaving cycle of the loom.

4 Claims, 8 Drawing Sheets

WEFT INSERTION IN JET LOOM

BACKGROUND OF THE INVENTION

1. Field of the Invention

The present invention relates to a method for weft insertion in a jet loom and an apparatus for carrying out the same and, more particularly, to a method for weft insertion in which a weft measuring roller is rotated in synchronism with the crankshaft of the loom to draw out a weft from a supply package, and an apparatus for carrying out the same.

2. Discussion of the Related Art

A jet loom measures and stores a weft of a length substantially corresponding to the width of a cloth being woven or to a length of two-thirds the width of the cloth prior to weft insertion, and then inserts the stored weft into the warp shed together with a jet of fluid for weaving by a main nozzle.

Japanese Utility Model Publication No. 50-13976 (1975) discloses a weft measuring device of a winding type. This known weft measuring device comprises a driving roller, a weft measuring roller pressed against the driving roller, and a grooved guide held on a fixed shaft disposed in parallel to the shaft of the weft measuring roller. In this known weft measuring device, the weft is wound several times around the weft measuring roller and the grooved guide, and the weft measuring roller is rotated to draw out the weft from a supply package by a predetermined length.

Japanese Patent Publication No. 38-21811 (1963) discloses a weft measuring device comprising a weft measuring roller and a pressure roller disposed opposite to the weft measuring roller. This known weft measuring device draws out a weft from a supply source weft by the measuring roller and the pressure roller pressed against the weft measuring roller and measures the length of the weft through the detection of rotation of the weft measuring roller. Another known weft measuring device is of a wind arm type.

Also known are weft storage devices of different types for storing a weft of a measured length, namely, a weft storage device of an air pool type which accumulates and stores a weft of a measured length in a floating condition by air, a weft storage device of an adhesion type which accumulates and stores a weft of a measured length in a zigzag shape on a moquette like, adhesive accumulating surface, and a weft storage device of a drum type which accumulates and stores a weft of a measured length in coils on a drum.

A weft measuring, accumulating and inserting operation of a jet loom employing the known weft measuring device of a winding type and a weft storage device of an air pool type will be described hereinafter with reference to FIG. 8.

A weft Y drawn out from a cheese 1, a supply package of the weft, through a tension control device 2 is coiled at a fixed speed for measuring around a weft measuring roller 5 rotating in synchronism with the rotation of the crankshaft of the loom and a guide 6 having a plurality of circumferential grooves 6*a* while the weft Y coiled around the weft measuring roller 5 and the guide 6 is blown into an accumulating pipe 9 of the weft storage device by an air current produced by a blowing 7 device of the weft storage device, and the weft Y blown into the accumulating pipe 9 is extended in a V-shape and is kept in a floating condition within the accumulating pipe 9 by an air current produced within the accumulating pipe 9 in the direction of an arrow A.

The weft Y accumulated and stored in the accumulating pipe 9 is drawn out through a longitudinal slit 9*a* formed in the wall of the accumulating pipe 9, and is guided through an eyelet 10 formed in the blowing device 7, a gripper 11 for alternately gripping and releasing the weft Y in a appropriate timing and a yarn guide 10*a* to a main nozzle 12.

In inserting the weft Y into the warp shed, the gripper 11 releases the weft Y immediately after the main nozzle 12 jets air, to draw out the weft Y from the accumulating pipe 9 through the slit 9*a* and to insert the weft Y into the warp shed. Then, the weft Y is carried by the jet of air along a guide channel S defined by air guide plates 13 for insertion. Upon the insertion of the weft Y by a length corresponding to that of a pick, the gripper 11 grips the weft Y to complete a weft inserting operation by stopping the further insertion of the weft Y into the warp shed.

The weft Y being drawn out from the cheese 1 at a constant drawing speed by the weft measuring roller 5 rotating at a constant speed is accumulated in the accumulating pipe 9 in a floating condition with the leading end thereof gripped by the gripper 11 for the next weft inserting cycle.

The length of the weft Y to be accumulated in the accumulating pipe 9 is dependent on the operating speed of the loom and the length of picks. Ordinarily, the length of the accumulated weft Y is on the order of two-thirds a length necessary for one picking cycle. Accordingly, the weft Y is supplied to the accumulating pipe 9 at a comparatively low speed, and then the accumulated and stored weft Y is drawn out from the accumulating pipe 9 at a high speed for weft insertion. The length of the accumulated weft Y extending in a V-shape along the accumulating pipe 9 between the wall 7*a* of the blowing device 7 and the eyelet 10 decreases gradually as the weft Y is inserted into the warp shed and, near the end of the weft inserting cycle, the accumulated weft Y extends in a line from an output of the blowing device 7 in the wall 7*a* to the eyelet 10. Generally, a running mode of the weft Y in a period from the start of weft insertion to a moment when the weft Y extends in a line between the exit of the blowing device 7 in the wall 7*a* and the eyelet 10 is designated as a free running mode. The running speed of the weft Y at the main nozzle 12 in the free running mode is represented by Vp. Thereafter, the weft Y measured by the weft measuring roller 5 is supplied directly to the main nozzle 12 without being accumulated in the accumulating pipe 9 in a floating condition and is inserted into the warp shed by the jet of air jetted by the main nozzle 12. Generally, a mode of running of the weft Y under this weft condition without accumulation is designated as a constrained running mode. In the constrained running mode, the weft Y runs at a running speed Vf coinciding with the surface speed of the weft measuring roller 5, i.e., a weft drawing speed drawn from the weft source, because there is no accumulated floating section in the weft Y. The weft measuring roller of the conventional measuring device is interlocked with the crankshaft of the loom, and hence the weft measuring roller rotates for measuring operation, except during a transient period subsequent to the start of the loom and a transient period precedent to the termination of the operation, at a constant surface speed Vf defined by: $Vf=Lo/tc$, where Lo is the weft length and tc is a time necessary for one weaving cycle of the loom.

FIG. 9A is a graph showing the variation of the running speed V of the inserted weft Y as measured at the main nozzle 2 with time, and FIG. 9B is a graph showing the variation of the tension T of the inserted weft Y as measured at a position between the guide 10*a* and the main nozzle 12 with time. When the running mode of the weft Y changes from the free running mode to the constrained running mode, the running speed V at the main nozzle drops suddenly from Vp to Vf as shown in FIG. 9A, and a peak tension Tp appears in the tension variation curve as shown in FIG. 9B at the moment when the running speed drops from Vp to Vf. At the end of the constrained running mode, namely, when the gripper 11 grips the weft Y upon the completion of inserting the weft Y by a predetermined length, the running speed of the weft Y drops suddenly from Vf to zero and the tension T resulting from the sudden variation of the running speed V increases sharply to another peak tension To. The relation between the variation of the running speed V and that of the tension T with reference to FIGS. 9A and 9B shows that the variation of the tension T is substantially proportional to the variation of the running speed V.

An increase in the operating speed of the loom entails an increase in the running speed difference Vp-Vf, hence an increase in the peak tension Tp. In some cases, the peak tension Tp exceeds the tensile strength of the weft Y so as to damage or break the weft Y or to spoil the running condition of the weft Y causing faulty weft insertion.

The weft storage device of an air pool type needs disadvantageously an accumulating pipe having an increased length, hence a large space for installation, when applied to a loom having an increased reed width.

Weft storage of an adhesion type device suffers from the drawbacks of an increase in weft tension when the running mode of the inserted weft changes from a free running mode to a constrained running mode and the need for a large space for installation when applied to a loom having a large reed width.

The weft storage device of a drum type suffers from weft breakage liable to occur when the running mode of the inserted weft changes from the free running mode on to the constrained running mode, increase in the number of coils of the weft on the weft metering drum when applied to a loom having a large weft length, and the resultant increase in the frequency of entanglement of the coils and faulty weft insertion.

SUMMARY OF THE INVENTION

The present invention is intended to solve the foregoing problems by improving a method for weft insertion and an apparatus for carrying out the same in a jet loom in which a weft is drawn out continuously from a supply package to accumulate and store temporarily a predetermined length of the weft, and then weft insertion is stated in an appropriate timing to insert the weft through two periods, namely, a first period corresponding to a period for the free running mode in which the accumulated weft is inserted, and a second period corresponding to a period for the constrained running mode in which the weft is inserted as the same is being drawn out from the supply source after the accumulated weft has been exhaused.

It is a primary object of the present invention to provide a method for weft insertion and an apparatus for carrying out the same, capable of suppressing a sudden increase in weft tension occurring when the running mode of the inserted weft changes from the free running mode to the constrained running mode so that weft will not be broken or damaged.

It is another object of the present invention to provide a method for weft insertion and an apparatus for carrying out the same, capable of ensuring the high-speed operation of the loom and stable weft insertion, and capable of reducing space for installing a weft storage device.

A method for weft insertion in a jet loom according to the present invention controls a weft inserting operation so that the running speed of the inserted weft at moment when the running mode changes from the free running mode to the constrained running mode is higher than a running speed Vf defined by: $Vf=Lo/tc$, where Lo is the weft length and tc is a time necessary for one weaving cycle of the loom.

An apparatus for carrying out the method for weft insertion in accordance with the present invention comprises: a weft measuring unit comprising a rotary member having a predetermined circumferential length and rotated in synchronism with the crankshaft of the loom; a weft storage unit for accumulating and storing a weft delivered thereto from the measuring unit before insertion; and a driving unit for changing the operating speed of the weft measuring unit so that the speed of drawing out the weft from a supply package immediately after the change of the running mode of the inserted weft from the free running mode to the constrained running mode is higher than a speed Vf defined by: $Vf=Lo/tc$, where Lo is the weft length and tc is the time necessary for one weaving cycle of the loom.

A weft inserting method according to the present invention accumulates and temporarily stores a predetermined measured length of a weft drawn out continuously from a supply package, a supply source of the weft at a predetermined drawing speed, e.g. Vf defined by: $Vf=Lo/tc$, where Lo is the weft length and tc is the time necessary for one weaving cycle of the loom until the start of weft insertion. In the weft inserting phase, the main nozzle jets air or water to insert the accumulated weft at a high speed in the free running mode. Upon the exhaustion of the accumulated weft, a weft measuring unit is feeding the weft directly to the main nozzle for weft insertion in the constrained running mode at a running speed higher than the speed Vf. A large variation in the running speed of the inserted weft at a moment when the running mode changes from the free running mode to the constrained running mode causes an increase in the weft tension at the same moment. However, when the running speed of the inserted weft in the constrained running mode is increased beyond the speed Vf, the sudden drop of the running speed of the inserted weft is reduced, thereby the peak weft tension is lowered accordingly and hence the inserted weft is rarely damaged or broken. When the peak weft tension can be lowered by increasing the running speed of the inserted weft in the constrained running mode, the weft inserting speed can be further increased to enhance the productivity of the jet loom. Furthermore, an increase in the running speed of the inserted weft in the constrained running mode enables an increase in the length of the weft drawn out from the supply package during the period of the constrained running mode, so that the length of the weft to be accumulated and stored before the start of weft insertion is reduced accordingly, and the space for accumulating the weft can be reduced.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DESCRIPTION OF THE PREFERRED EMBODIMENTS

Figure 1:
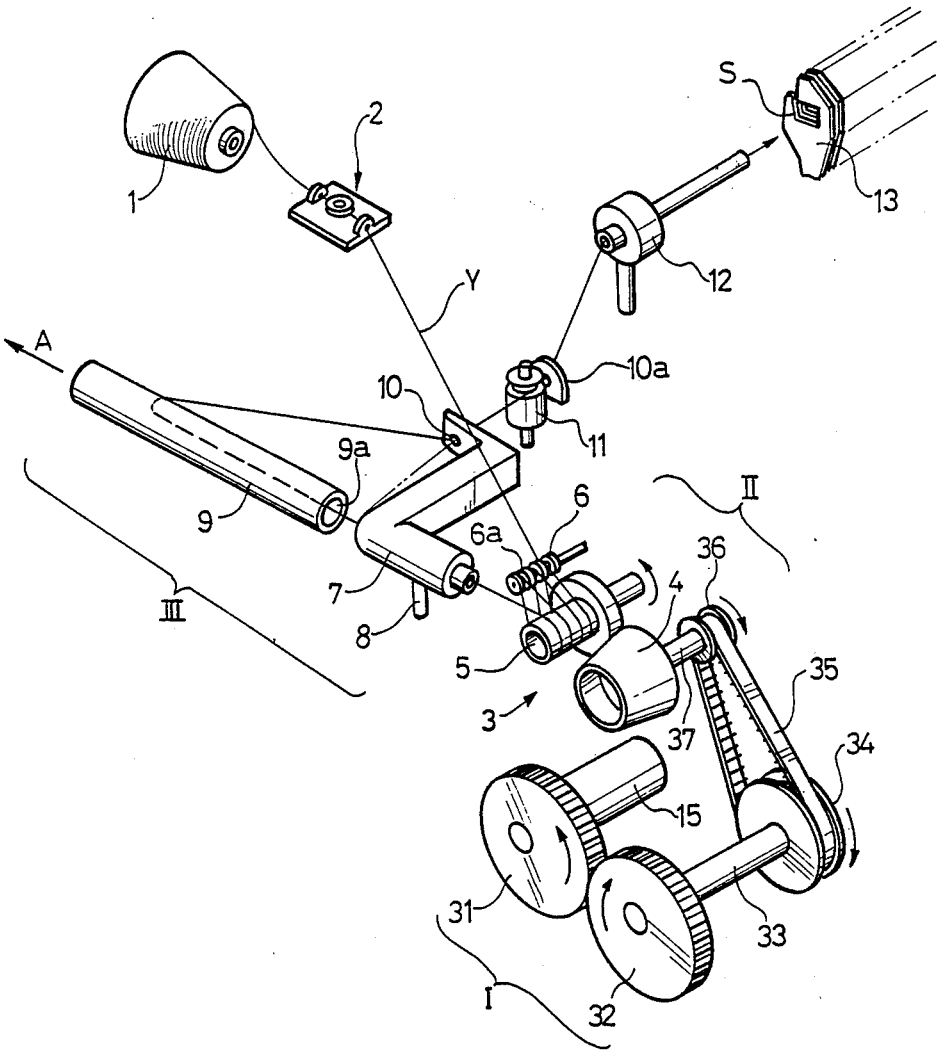
FIG. 1 is a perspective view showing an essential portion of a weft inserting apparatus in a first embodiment according to the present invention for a jet loom.

An apparatus for weft insertion in a jet loom in accordance with the present invention will be described hereinafter with reference to the accompanying drawings.

The weft measuring unit of the weft inserting apparatus in accordance with the present invention for a jet loom comprises the rotary member having a predetermined circumferential length, and the rotary member is rotated in synchronism with the crankshaft of the loom to draw out a weft continuously from a supply package by a predetermined length of the weft. The measured length of the weft is accumulated in the weft storage unit and is stored until the start of weft insertion. In the initial stage of a weft inserting cycle, the accumulated weft is inserted in the free running mode by a jet. Upon exhaustion of the accumulated weft, the weft drawn out from the supply package by the weft measuring unit is inserted directly in the constrained running mode without being accumulated. The driving unit changes the rotating speed of the rotary member of the weft measuring unit when the running mode changes from the free running mode to the constrained running mode so that the weft is drawn out from the supply pakage at a speed higher than the speed Vf defined by: $Vf=Lo/tc$, where Lo is the weft length and tc is the time necessary for one weaving cycle of the loom, and thereby the difference between the running speed in the free running mode and the running speed in the constrained running mode is diminished and hence the peak weft tension at the moment of change of the running mode from the free running mode to the constrained running mode is lowered accordingly. When the running speed of the weft in the constrained running mode is increased, the length of the weft drain out from the supply package during the period of the constrained running mode is increased accordingly, so that the length of the weft to be accumulated can be reduced and hence the weft storage unit can be constructed with a reduced size. Furthermore, the drop of the peak weft tension enables an increase in the operating speed of the loom, hence the weft inserting speed, and thereby the productivity of the loom can be improved.

In one aspect of the present invention, a weft inserting apparatus for a jet loom, which draws out a weft continuously from a supply package, accumulates and stores a predetermined length of the weft temporarily, and inserts the weft with appropriate timing in two periods, namely, a first period in which the accumulated weft is inserted in the free running mode by a jet from the main nozzle and a second period in which the weft drawn out from the supply package is inserted directly by a jet from the main nozzle in the constrained running mode without being accumulated after the exhaustion of the accumulated weft, comprises: a weft measuring unit having a weft measuring roller rotated in sychronism with the crankshaft of the loom and having a predetermined circumferential length; a weft storage unit for accumulating and storing the weft delivered thereto from the weft measuring unit until the start of weft insertion; and a driving unit which changes the rotating speed of the weft measuring roller so that the drawing speed of the weft measuring roller at the moment of change of the running mode from the free running mode to the constrained running mode is higher than a speed Vf defined by: $Vf=Lo/tc$, where Lo is the weft length and tc is a time necessary for one weaving cycle of the loom. This weft inserting apparatus is characterized in that the weft measuring unit comprises a driving drum driven by the driving source of the loom and the measuring roller pressed against the driving drum for rotation, and that the driving unit comprises a non-circular gear drain including elliptic gears to drive the driving drum so that the surface speed of the weft measuring roller varies sinusoidally every one turn of the crankshaft of the loom in synchronism with the rotation of the crankshaft and the surface speed of the weft measuring roller reaches a maximum at a moment when the running mode of the inserted weft changes from the free running mode to the constrained running mode.

In another aspect of the present invention, a weft inserting apparatus for a jet loom, which draws out a weft continuously from a supply package, accumulates and stores a predetermined length of the weft temporarily, and inserts the weft in an appropriate timing in two periods, namely, a first period in which the accumulated weft is inserted in the free running mode by a jet from the main nozzle and a second period in which the weft drawn out from the supply package is inserted directly by a jet from the main nozzle in the constrained running mode without being accumulated after the exhaustion of the accumulated weft, comprises: a weft measuring unit having a weft measuring roller having a predetermined circumferential length and driven in sychronism with the crankshaft of the loom; a weft storage unit which accumulates and stores the weft delivered thereto from the weft measuring unit until the start of weft insertion; and a driving unit which changes the rotating speed of the weft measuring roller so that the drawing speed at a moment when the running mode of the inserted weft changes from the free running mode to the constrained running mode is higher than a speed Vf defined by: $Vf=Lo/tc$, where Lo is the weft length of the loom and tc is a time necessary for one weaving cycle of the loom. This weft inserting apparatus is characterized in that the weft measuring unit comprises the weft measuring roller, and that the driving unit comprises a variable-speed motor and a controller for the variable-speed motor to control the driving unit so that the surface speed of the weft measuring roller is varied sinusoidally every one turn of the crankshaft in synchronism with the rotation of the crankshaft, and the surface speed of the weft measuring roller reaches a maximum at a moment when the running mode of the inserted weft changes from the free running mode to the constrained running mode.

When the surface speed of the weft measuring roller is thus controlled, the drop of the running speed of the inserted weft as measured at the main nozzle at the moment when the running mode changes from the free running mode to the constrained running mode is diminished and hence the sudden increase in the weft tension is suppressed and, consequently, the possibility of faulty weft insertion can be reduced. Furthermore, since the length of the weft drawn out during the period of the constrained running mode can be increased and hence less length of the weft may be accumulated in the weft storage unit, the weft storage unit can be constructed of a reduced size to save space for installation. The employment of the variable-speed motor, such as a servomotor, in the driving unit for varying the surface speed of the weft measuring roller enables the arbitrary variation of the surface speed of the weft measuring roller, and the weft measuring roller can be controlled in an optimum mode for surface speed variation simply by setting the controller for optimum surface speed control. The use of the servomotor instead of the non-circular gear train including the elliptic gears enables the driving unit to be constructed of a reduced size, which saves space for installing the weft storage unit and enables the enhancement of the weft inserting rate.

The method for weft insertion in accordance with the present invention for a jet loom controls the running speed of an inserted weft at a moment when the running mode changes from the free running mode to the constrained running mode so that the running speed is higher than a speed Vf defined by: $Vf=Lo/tc$, where Lo is the weft length of the loom and tc is the time necessary for one weaving cycle of the loom, corresponding to a drawing speed at which a weft is drawn out from a supply package. Accordingly, the drop of the running speed of the inserted weft at the moment when the running mode changes from the free running mode to the constrained running mode is diminished and hence the increase in the weft tension at that moment of the change of the running mode is suppressed; consequently, the weft is rarely broken or damaged to ensure stable weft inserting operation. Furthermore, since the drop of the running speed of the inserted weft decreases only slightly at the moment of the change of the running mode, the running condition of the inserted weft is not spoiled, faulty weft insertion is prevented and weft inserting operation can be smoothly achieved. The diminution of the peak weft tension enables an increase in the weft insertion rate, hence the operating speed of the loom. Still further, since an increased length of the weft can be drawn out from the supply package during the period of the constrained running mode, less length of the weft may be accumulated, and hence less space is necessary for weft accumulation.

Moreover, since a comparatively small length of the weft is accumulated, resistance against the insertion of the accumulated weft at the start of weft insertion is reduced, the mass to be moved in inserting the accumulated weft is reduced, the resistance of air against the movement of the accumulated weft is reduced, and hence the jetting pressure of the main nozzle can be reduced; consequently, the power required for supplying compressed air can be diminished.

A weft inserting apparatus in accordance with the present invention for a jet loom has a driving unit capable of varying the weft measuring speed of the weft measuring unit so that the drawing speed at which the weft is drawn out from the supply package at the moment of the change of the running mode of the inserted weft is higher than the speed Vf defined by $Vf=Lo/tc$, where Lo is the weft length of the loom and tc is a time necessary for one weaving cycle of the loom. Accordingly, the difference between the running speed of the weft in the free running mode and that of the same in the constrained running mode is reduced in proportion to the increase in the measuring speed of the weft measuring unit at the moment of change of the running mode from the free running mode to the constrained running mode, and thereby the peak weft tension at the moment of the change of the running mode is lowered. Hence the inserted weft is rarely broken or damaged. Furthermore, the reduction of the peak weft tension enables the weft insertion rate, hence the operating speed of the loom, to be increased.

Still further, since the length of the weft drawn out from the supply package during the period of the constrained running mode is increased, the length of the weft to be accumulated can be reduced accordingly, and hence the weft storage unit can be constructed with a comparatively small size. Moreover, since the length of the weft to be accumulated is reduced, the resistance against the insertion of the weft at the start of weft insertion is comparatively small, the mass of the weft to be moved by a jet is small and the resistance of air against the movement of the accumulated weft is comparatively small. Accordingly, the jetting pressure of the main nozzle can be reduced and thereby power for producing compressed air can be reduced.

FIRST EMBODIMENT (FIGS. 1 TO 5)

A first embodiment according to the present invention comprises, as essential components, a driving unit I, a weft measuring unit II of a measuring roller type, a weft storage unit III of an air pool type, and a weft supply unit. The driving unit I is provided with a driving elliptic gear 31 and a driven elliptic gear 32 engaging the driving elliptic gear 31.

Figure 2:
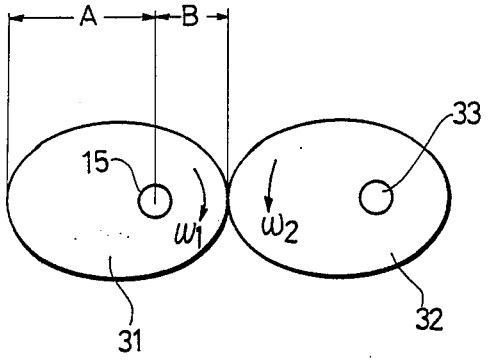
FIG. 2 is a diagrammatic illustration for explaining the function of elliptic gears included in a non-circular gear train.

Driving Unit I:

The elliptic gears 31 and 32 are 2 in module and 49 in the number of teeth. The driving elliptic gear 31 is fixed to one end of the crankshaft 15 of the loom, and the driven elliptic gear 32 is fixed to one end of a shaft 33. A timing belt pulley 34 is fixed to the other end of the shaft 33. The timing belt pulley 34 is interlocked with a timing belt pulley 36 provided in the weft measuring unit II by a timing belt 35. The crankshaft 15 and the shaft 33 are journaled on a frame. The eccentricity of the elliptic gears 31 and 32 is 0.2. The eccentricity is expressed by the relationship $(A-B)/(A+B)$, where A is the distance between one end of the major axis of the elliptic gear 31 (32) and the axis of rotation of the elliptic gear 31 (32), i.e., a e center axis of the crankshaft 15 (the shaft 33), B is the distance between the other end of the major axis of the elliptic bear 31 (32) and the axis of rotation of the elliptic gear 31 (32), i.e., the center axis of the crankshaft 15 (the shaft 33) (FIG. 2).

Weft Measuring Unit II:

The weft measuring unit II comprises the timing belt pulley 36, a driving drum 4, a measuring roller 5 and a yarn guide 6. The timing belt pulley 36 and the driving drum 4 are fixed respectively to the opposite ends of a shaft 37 journaled on the frame.

The driving drum 4 is a surface drive drum having the shape of a truncated circular cone. The weft measuring roller 5 is disposed so as to be brought into contact with the circumference of the driving drum 4. The measuring roller 5 is a friction roller with its circumference coated with a rubber coating. The yarn guide 6 is provided with a plurality of annular grooves 6*a* on the circumference thereof and is held on a fixed shaft extended in parallel to the axis of rotation of the weft measuring roller 5.

Weft Storage Unit III:

The weft storage unit III is the same as the aforesaid conventional weft storage unit of an air pool type, and hence description thereof will be omitted to avoid duplication.

The operation of the weft inserting apparatus thus constructed will be described hereinafter.

Figure 3:
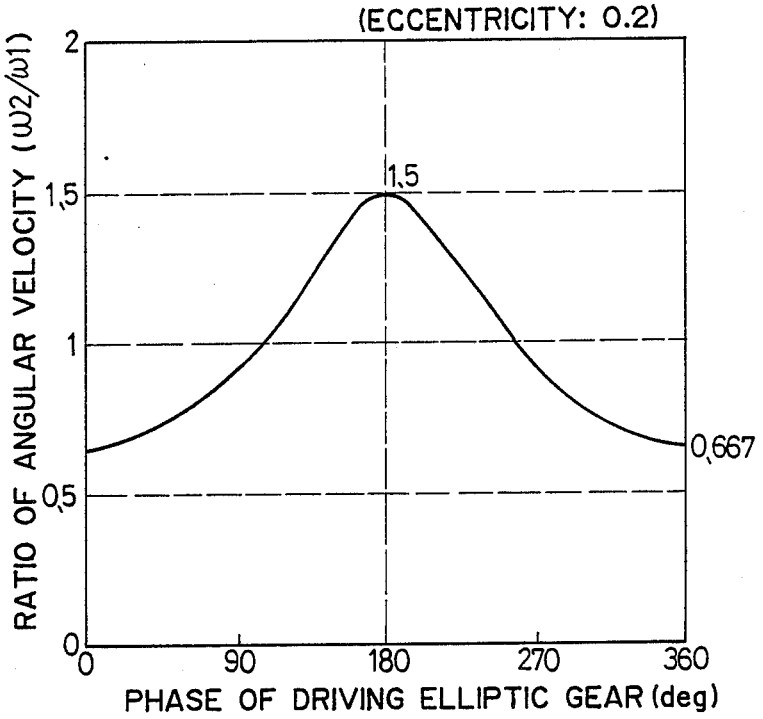
FIG. 3 is a graph showing the variation of the angular speed ratio between driving and driven elliptic gears of FIG. 2 with the phase of the driving gear.

When the crankshaft 15 of the loom is driven for rotation at a constant angular velocity, the driven elliptic gear 32 is driven for rotation by the driving elliptic gear 31 fixed to the crankshaft 15. The angular velocity of the driven elliptic gear 32 varies during one turn thereof. The variation of the ratio $\omega 2/\omega 1$ of angular velocity ($\omega 1$ is the angular velocity of the driving elliptic gear 31, $\omega 2$ is the angular velocity of the driven elliptic gear 32) with the phase of the driving elliptic gear 31 is shown in FIG. 3. The angular velocity $\omega 2$ of the driven elliptic gear 32 varies in the range of 0.667 to 1.5 times the angular velocity $\omega 1$ of the driving elliptic gear 31 (the angular velocity of the crankshaft 15) in synchronism with the rotation of the crankshaft 15. The rotation of the driven elliptic gear 32 is transmitted through the timing belt pulley 34 and the timing belt 35 to the timing belt pulley 36 of the weft measuring unit II with an increased angular velocity and further through the driving drum 4 to the weft measuring roller 5 with an increased angular velocity to draw out a weft Y from a cheese 1, supply package of the weft, by a length corresponding to a pick length every one turn of the crankshaft 15.

Figure 5:
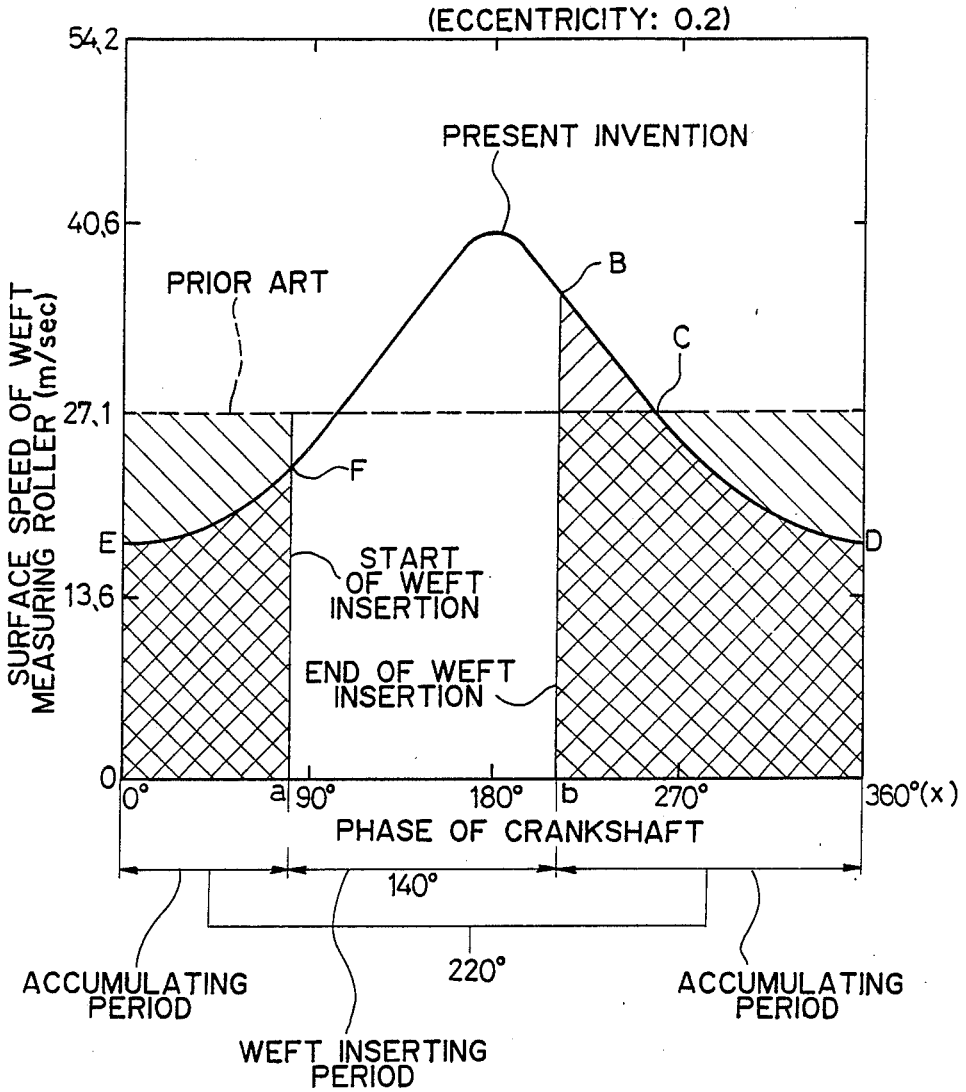
FIG. 5 is a graph showing the relation between the surface speed of a weft measuring roller and the phase of the crankshaft of the loom in the operation of the weft inserting apparatus of FIG. 1.

Suppose that the pick length is 3.6 m and the operating speed of the loom, i.e., the rotating speed of the crankshaft 15, is 450 rpm. Then, the surface speed of the weft measuring roller 5 varies sinusolidally in the range of 18.1 m/sec to 40.6 m/sec every one turn of the driving elliptic gear 31 as shown in FIG. 5.

The weft Y drawn out from the cheese 1 is coiled around the weft measuring roller 5 rotating at a sinusoidally varying surface speed in synchronism with the rotation of the crankshaft 15, and the yarn guide 6 provided with the plurality of annular grooves 6*a*. Since the circumference of the weft measuring roller 5 is coated with the frictional rubber coating, the weft measuring roller 5 meters the weft Y surely without slip. Then, the weft Y is blown into the accumulating pipe 9 by the blowing member 7 and is kept in a floating condition within the accumulating pipe 9 by an air current flowing in the direction of an arrow A. The weft Y is folded in a V-shape near the exit of the accumulating pipe 9 and is guided through a longitudinal slit 9*a* formed in the wall of the accumulating pipe 9, an eyelet 10 formed in one end of the blowing member 7, and the gripper 11 for alternately gripping and releasing the weft Y to the main nozzle 12.

At the beginning of a weft inserting phase, the main nozzle 12 jets an air jet and the gripper releases the weft Y immediately after the main jet 12 has jetted the air jet. Then, the weft Y is drawn out from the accumulating pipe 9 through the slit 9*a* and is inserted into the warp shed along a guide channel S defined by air guide plates 13 by the air jet from the main nozzle.

After a predetermined length of the weft Y has been inserted, the gripper 11 grips the weft Y to terminate the weft inserting operation. Although the weft Y is being drawn out continuously from the cheese 1, supply package, and is being blown continuously into the accumulating pipe 9 by the air current flowing in the direction of the arrow A, the weft Y is stored in a floating condition within the accumulating pipe 9 in a V-shape between the exit portion of the blowing member 7 and the eyelet 10 for the next weft inserting operation, because the weft Y is gripped by the gripper 11 and hence is unable to advance toward the main nozzle 12.

Results of experimental weaving operation showed that the weft inserting operation can satisfactorily and smoothly be achieved when a period during which the weft Y is released from the gripper 11, namely, a period from a moment when the gripper 11 releases the weft Y to a moment when the gripper grips the weft Y, corresponds to an angular range of 140° of rotation of the crankshaft 15 of the loom in the crankshaft phase range of 120° to 260°, and a crankshaft phase at which the surface speed of the weft measuring roller 5 reaches a maximum is in the crankshaft phase range of 190° to 245°. That is, the running mode of the weft Y changes from the free running mode to the constrained running mode at a moment 15° to 70° in crankshaft phase before a moment when the gripper 11 grips the weft Y. Therefore, the driving unit I is set so that the surface speed of the weft measuring roller 5 reaches the maximum (40.6 m/sec) at a moment when the running mode changes from the free running mode to the constrained running mode; consequently, the running speed of the inserted weft Y is increased according to the increase of the surface speed of the weft measuring roller 5.

Although the first embodiment employs a non-circular gear train including the elliptic gears 31 and 32 as means for varying the surface speed of the weft measuring roller 5, other non-circular gear trains including irregular formed gears other than elliptic gears, or a combination of irregular formed timing belt pulleys interlocked by a timing belt may be used for the same purpose.

Figure 4A:
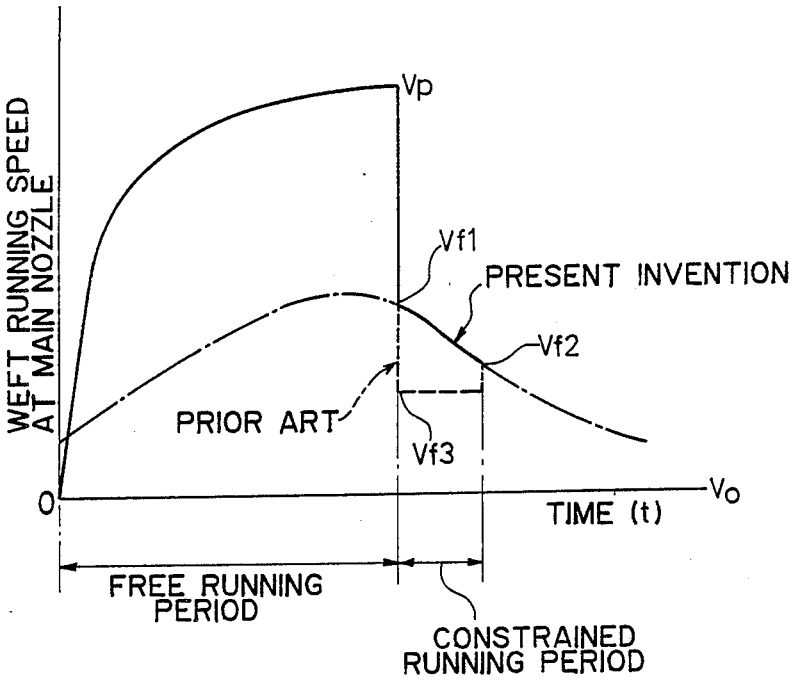
FIG. 4A is a graph showing the variation of the running speed of an inserted weft as measured at the exit of the main nozzle of a loom with time in the operation of the weft inserting apparatus of FIG. 1.

The relation between the variation of the running speed of the inserted weft Y at the exit of the main nozzle 12 with time and the variation of the weft tension with time at the moment of change of the running mode from the free running mode to the constrained running mode will be examined hereinafter with reference to FIGS. 4A and 4B. Suppose that a conventional weft inserting apparatus which rotates a weft measuring roller at a constant surface speed Vf2 defined by: $Vf2=Lo/tc$, where Lo is the weft length and tc is a time necessary for one weaving cycle of the loom, and the weft inserting apparatus in accordance with the present invention allow the inserted weft Y to run at the same running speed Vp as measured at the exit of the main nozzle 12 at a moment when the running mode of the inserted weft Y changes from the free running mode to the constrained running mode. Then, the running speed of a weft inserted by the conventional weft inserting apparatus drops from Vp to Vf3 by a speed drop Vp−Vf3 at a moment when the running mode changes from the free running mode to the constrained running mode as indicated by a broken line in FIG. 4A. On the other hand, the running speed of a weft inserted by the weft inserting apparatus of the present invention drops under the same condition by a speed drop Vp−Vf1, which is smaller than the speed drop Vp−Vf3, because the surface speed of the weft measuring roller 5 varies as indicated by alternate long and short dash line in one weaving cycle and the surface speed of the weft measuring roller reaches the maximum near the moment when the running mode of the inserted weft changes from the free running mode to the constrained running mode. When the rotating speed of the crankshaft of the loom is 400 rpm, the weft length is 3.6 m and the eccentricity of the elliptic gears is 0.2, the drop Vp−Vf1 is less than the drop Vp−Vf3 by about 40% of the latter.

Figure 4B:
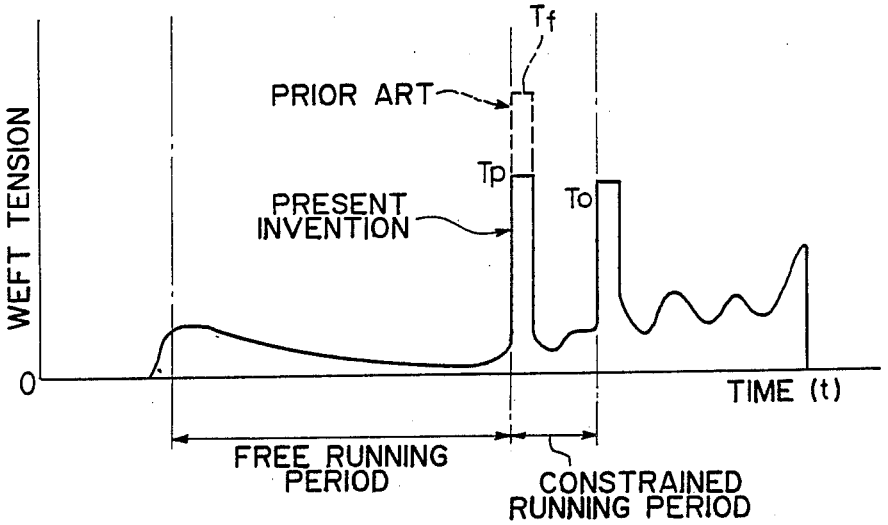
FIG. 4B is a graph showing the variation of weft tension with time in the operation of the weft inserting apparatus of FIG. 1.

FIG. 4B shows the variation of the weft tension with time during the periods of the free running mode and the constrained running mode. While the weft is running in the free running mode, the weft tension is low. Upon exhaustion of the weft stored in the accumulating pipe 9, the running mode changes from the free running mode to the constrained running mode, in which the weft is supplied directly from the weft measuring roller 5 to the main nozzle 12. Consequently the weft tension increases sharply to a peak tension Tp. When the running weft is gripped by the gripper 11, the weft tension increases sharply again to a peak To. In FIG. 4B, a solid line indicates the variation of the weft tension in inserting the weft by the weft inserting apparatus of the present invention, and a broken line indicates the variation of the weft tension in inserting the weft by the conventional weft inserting apparatus. The peak tension Tp is lower than a peak tension Tf of the weft inserted by the conventional weft inserting apparatus running at a running speed lower than that of the weft inserted by the weft inserting apparatus of the present invention at the moment when the running mode changes from the free running mode to the constrained running mode. When the rotating speed of the crankshaft, the weft length and the eccentricity of the elliptic gears are the same as those mentioned above, the peak tension Tp is lower than the peak tension Tf by about 30% of the peak tension Tf.

Thus, the weft inserting apparatus of the present invention reduces the peak tension of the inserted weft below that of the weft inserted by the conventional weft inserting apparatus. Consequently, the problem that the inserted weft is broken or damaged when the running mode changes from the free running mode to the constrained running mode is solved, and reduction in the drop of the running speed of the inserted weft at the moment of change of the running mode stabilizes the running condition of the inserted weft, and thereby the possibility of faulty weft insertion is reduced.

FIG. 5 shows the relation between the phase of the driving elliptic gear 31 and the surface speed of the weft measuring roller 5 in the weft inserting apparatus of the present invention in one weaving cycle in comparison with the same relation in the conventional weft inserting apparatus, in which a solid line indicates the relation in the weft inserting apparatus of the present invention, and the broken line indicates the relation in the conventional weft inserting apparatus.

In a weft accumulating period, namely, a period from the termination of weft insertion by gripping the weft by the gripper 11 to the start of the next weft insertion, the surface speed of the weft measuring roller 5 is higher than that of the measuring roller of the conventional weft inserting apparatus in a period from a phase B immediately after the termination of weft insertion to a phase C a little time after the termination of weft insertion, and the surface speed of the measuring roller 5 is lower than that of the measuring roller of the conventional weft inserting apparatus in periods from the phase C to a phase D, and from phase E to a phase F. Accordingly, the length of the weft metered by the weft metered roller 5 during the accumulating period is smaller than that metered by the measuring roller of the conventional weft inserting apparatus during the same period.

The integral from x=b to x=c of the surface speed of the measuring roller (a function of phase) with respect to phase equals to the length of the weft accumulated in a period from the termination of weft insertion to the start of the next weft insertion. In FIG. 5, an area hatched by oblique lines declining to the left representing the length of the weft accumulated by the weft inserting apparatus of the present invention (the eccentricity of the elliptic gears=0.2), which is smaller than an area hatched by oblique lines declining to the right representing the length of the weft accumulated by the conventional weft inserting apparatus by about 20% of the latter. Concretely, the length of the weft accumulated by the conventional weft inserting device in the accumulating period (220° in angular width) is 2.2 m, while the length of the weft accumulated by the weft inserting apparatus of the present invention in the same period is 1.75 m, which is shorter than the former length by about 20%. Accordingly, the length of the accumulating pipe 9 of the weft inserting apparatus of the present invention may be shorter than that of the accumulating pipe of the conventional weft inserting apparatus, so that the weft inserting apparatus of the present invention needs less space as compared with the space necessary for installing the conventional weft inserting apparatus.

The weft inserting apparatus of the present invention stores a less length of the weft, and hence less mass, as compared with the conventional weft inserting apparatus. The present invention reduces resistance against the insertion of the weft at the start of weft insertion, reduces the mass to be moved in inserting the weft and reduces the resistance of air against the movement of the accumulated weft, so that the jetting pressure of the main nozzle can be reduced and power for producing compressed air can be reduced.

Furthermore, since the peak tension of the weft drops, the weft inserting rate can be increased and the rotating speed of the crankshaft, hence the operating speed of the loom can be raised. Concretely, the rotating speed of the crankshaft can be raised by a value on the order of 25% as compared with the rotating speed of the crankshaft of the loom equipped with the conventional weft inserting apparatus, provided that the surface speed of the weft measuring roller is fixed.

Although the first embodiment of the present invention employs elliptic gears of 0.2 in eccentricity, the advantageous effect of the present invention can be further enhanced by employing elliptic gears having a higher eccentricity. However, the eccentricity of the elliptic gears is limited because elliptic gears having an excessively large eccentricity entail problems such as undesirable vibrations.

SECOND EMBODIMENT (FIGS. 6 AND 7)

A second embodiment according to the present invention employs a servomotor as means for varying the surface speed of a weft measuring roller, and a weft storage device of an adhesion type as a weft storage unit.

A driving system employed in the second embodiment is the same as the driving system of the first embodiment except that the driving system employed in the second embodiment is provided with a servomotor specially for weft insertion in addition to a motor for driving the loom. Accordingly, parts like or corresponding to those of the first embodiment are denoted by the same reference characters and the description thereof will be omitted to avoid duplication.

Figure 6:
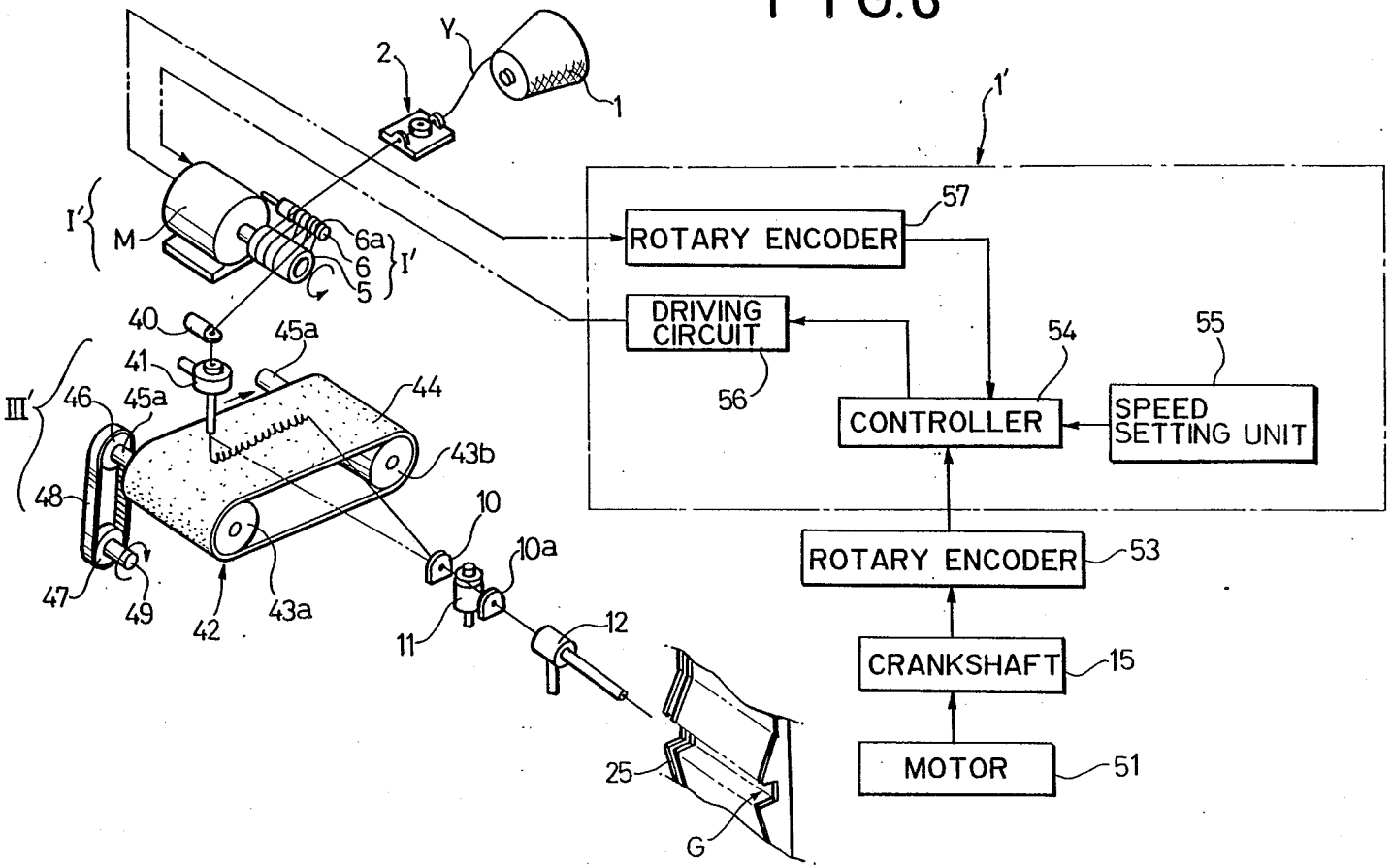
FIG. 6 is a perspective view of an essential portion of a weft inserting apparatus in a second embodiment according to the present invention.

Referring to FIG. 6, the weft inserting apparatus in a second embodiment according to the present invention comprises a driving unit I', a weft measuring unit II' and a weft storage unit III'.

Driving Unit I':

The jet loom is provided two separate motors, namely, a servomotor M specially for the driving unit I', and a motor 51 for driving the crankshaft thereof. The servomotor M is driven by a motor driving circuit 56, which in turn is controlled by a controller 54. Connected also to the controller 54 are a speed setting unit 55 for setting a speed in which the surface speed of a weft measuring roller 5 is controlled, a rotary encoder 57 for detecting the angular speed of the output shaft of the servomotor M, and a rotary encoder 53 for detecting the phase of the crankshaft 15 of the loom driven by the motor 51.

Weft Measuring Unit II':

The weft measuring roller 5 is fixed to the output shaft of the servomotor M. A weft Y is drawn out from a cheese 1, a supply package of the weft, through a tension controller 2 by the weft measuring roller 5 and is coiled around the weft measuring roller 5 and a guide 6 for measuring.

Weft Storage Unit III':

The weft storage unit III' employs a weft storage device of an adhesion type. The weft Y coiled around the weft measuring roller 5 and the guide 6 is guided to a weft accumulating nozzle 41 disposed in a vertical position by a yarn guide 40. The yarn guide 40 is positioned above the weft accumulating nozzle 41. A weft accumulating device 42 of a rotary belt type is disposed below the nozzle hole of the weft accumulating nozzle 41. The weft accumulating device 42 has an endless belt having an outer, moquett-like accumulating surface 44 formed by raising the surface of a textile material or the like, or by flocking. The endless belt is extended around a pair of rollers 43*a* and 43*b* so that the accumulating surface 44 will move in a horizontal plane. A timing belt pulley 46 fixed to one end 45*a* of the roller 43*a* is interlocked with a timing belt pulley 47 fixed to a shaft 49 by a timing belt 48. The shaft 49 is driven by the motor 51 of the loom to drive the endless belt.

The weft inserting apparatus includes, as principal components, a gripper 11, a main nozzle 12, a modified reed 25 (corresponding to the air guide of the first embodiment), which are the same as those employed in the foregoing conventional weft inserting apparatus, hence these components are denoted by the same reference characters and the description thereof will be omitted.

Operation of the weft inserting apparatus thus constructed will be described hereinafter.

Suppose that the rotating speed of the crankshaft of the loom is Vm (rpm), the weft length is L (cm) and the diameter of the weft measuring roller 5 is D (cm). Then, the rotating speed Vf (rpm) of the weft measuring roller 5 is expressed by:

$$Vf = L \cdot Vm / \pi \cdot D$$

This expression is applicable to calculating the rotating speed Vf of the weft measuring roller 5 when the weft measuring roller 5 is driven for constant rotation. According to the present invention, the rotating speed of the weft measuring 5 is varied in one weaving cycle of the loom. The manner of controlling the rotating speed of the weft measuring roller 5 for variable rotation will be described hereinafter, in which it is assumed, by way of example, that the rotating speed of the weft measuring roller 5 is varied sinusoidally.

Set values respectively for the following four parameters are set by operating the speed setting unit 55, and then the set values are given to the controller 54.

(1) Rotating speed of the crankshaft of the loom
(2) Weft length (reed width + length of waste selvages)
(3) Rotating speed change ratio for the weft measuring roller
(4) Phase of the crankshaft where the rotating speed of the weft measuring roller reaches a maximum.

When the loom is started, the rotary encoder 53 detects the phase of the crankshaft of the loom and gives a detection signal to the controller 54. Then, the controller 54 calculates the rotating speed for the weft measuring roller 5 on the basis of the foregoing set values to drive the servomotor M accordingly through the driving circuit 56. The rotary encoder 57 detects the rotating speed of the servomotor M continuously and gives a detected signal to the controller 54, and then the controller 54 processes the detected signal with reference to the set values to drive the servomotor M properly through the driving circuit 56. Suppose that the set values set by operating the speed setting unit 55 are:

(1) Rotating speed of the crankshaft of the loom: 800 rpm
(2) Weft length: 1.8 m
(3) Rotating speed change ratio: ±80%
(4) Phase of crankshaft where the rotating speed of the weft measuring roller reaches a maximum: 200°.

Figure 7:
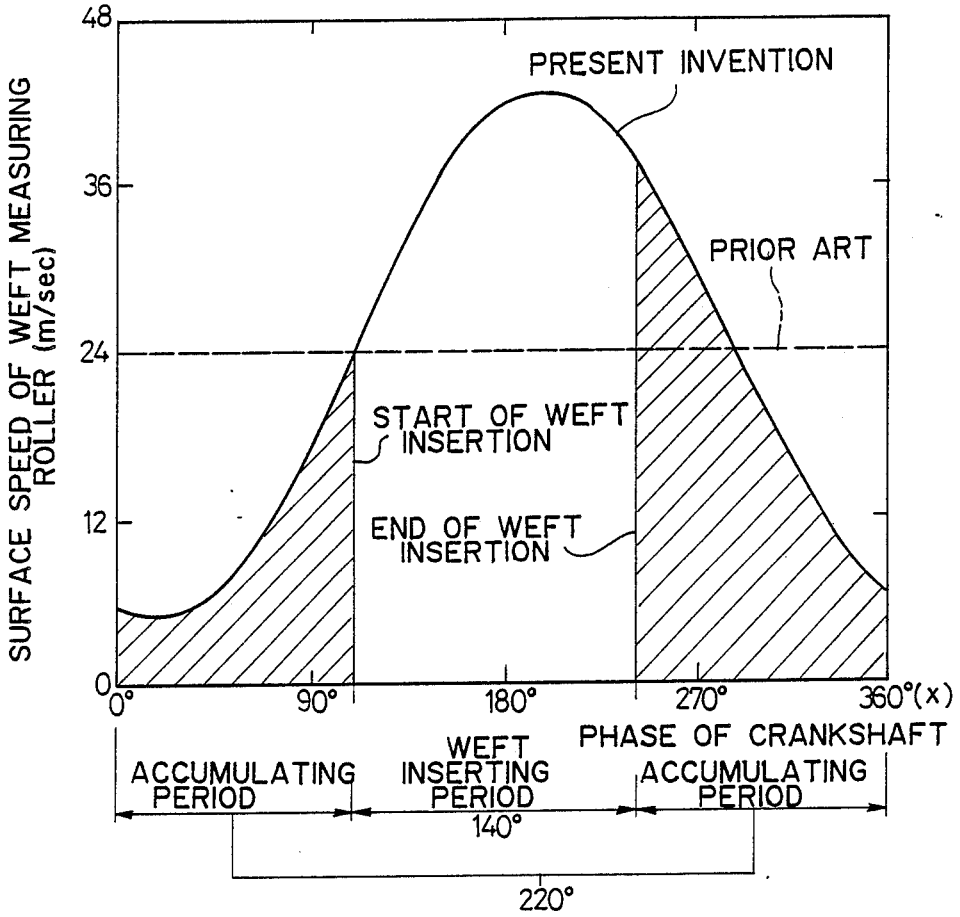
FIG. 7 is a graph showing the relation between the surface speed of a weft measuring roller and the phase of the crankshaft of the loom in the operation of the weft inserting apparatus of FIG. 6.
Figure 8:
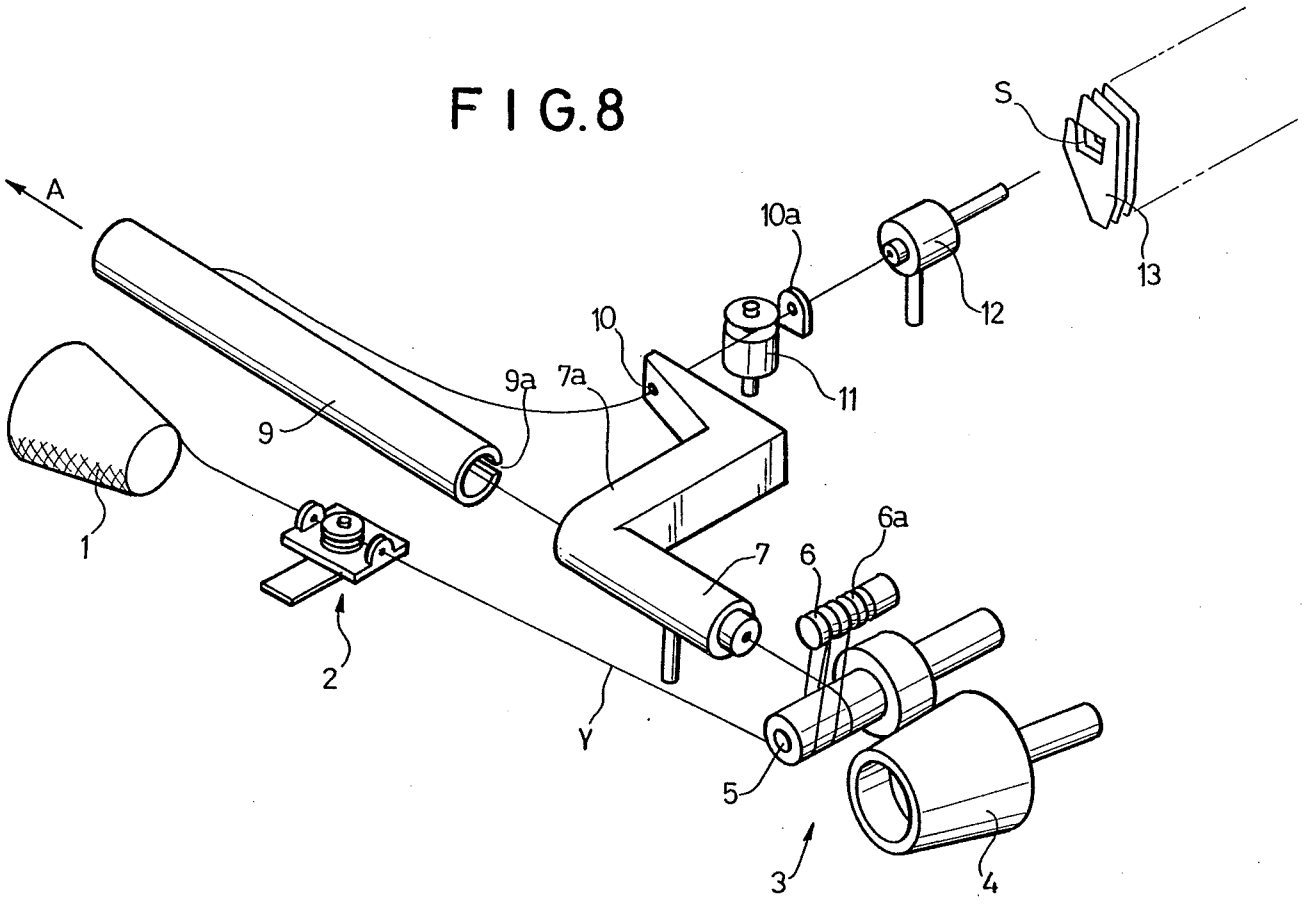
FIG. 8 is a perspective view of an essential portion of a conventional weft inserting apparatus for a jet loom.
Figure 9A:
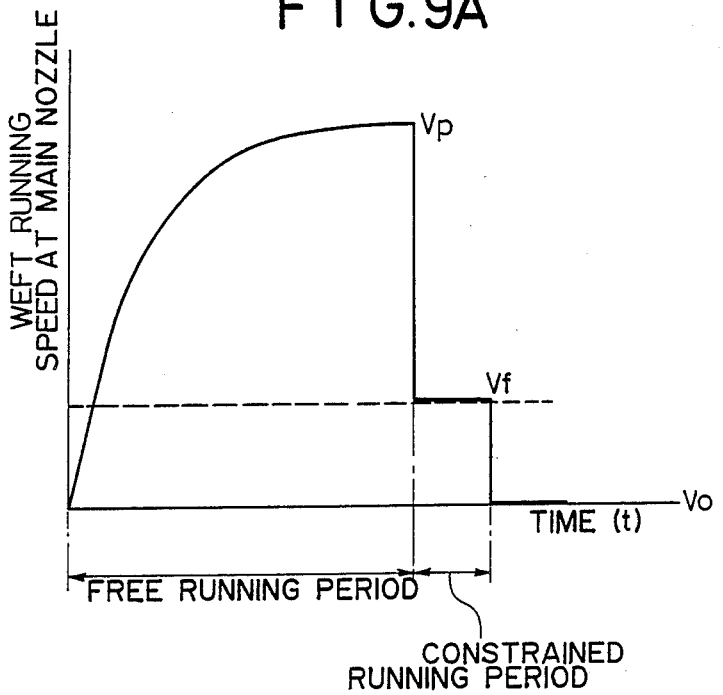
FIG. 9A is a graph showing the variation of the running speed of an inserted weft as measured at the exit portion of the main nozzle of a loom with time in the operation of the weft inserting apparatus of FIG. 8.
Figure 9B:
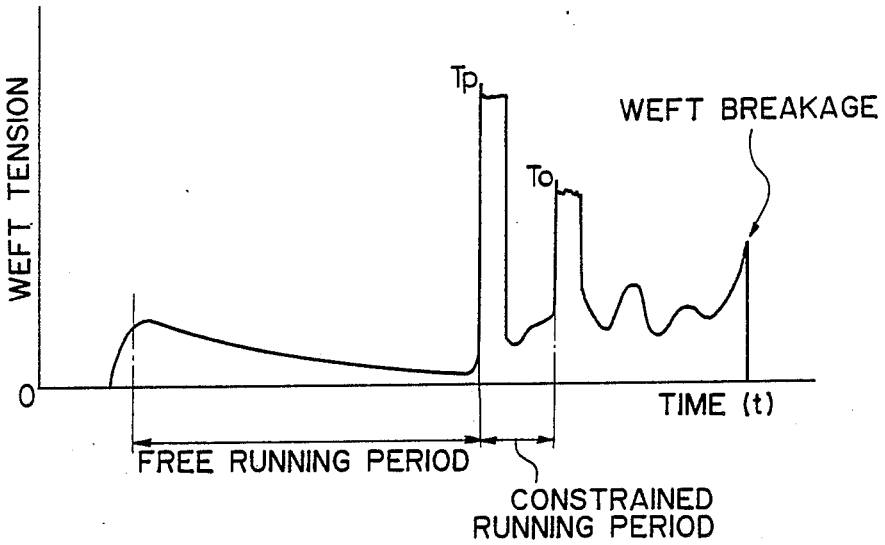
FIG. 9B is a graph showing the variation of weft tension with time in the operation of the conventional weft inserting apparatus of FIG. 8.

Then, the variation of the surface speed of the weft measuring roller is represented by a sine curve as shown in FIG. 7. As is obvious from FIG. 7, the surface speed of the weft measuring roller is lower in most part of the accumulating period than that of the conventional weft measuring roller which is driven for constant rotation, and is higher than that of the conventional weft measuring roller in the weft inserting period. The range of variation of the surface speed of the weft measuring roller is 4.8 to 43.2 m/sec.

On the other hand, the weft Y is drawn out from the cheese 1 through the tension controller 2 by the rotating weft measuring roller 5, the weft Y is coiled around the weft measuring roller 5 and the guide 6 having a plurality of annular grooves 6*a* in the weft measuring unit II', and then the weft Y is delivered to the weft storage unit III'. Then, the weft Y is guided by the guide 40 to the weft accumulating nozzle 41 and is blown by the weft accumulating nozzle 41 against the accumulating surface 44 of the endless belt disposed below the weft accumulating nozzle 41. When blown against the accumulating surface 44, the weft Y is caught and held frictionally between the fibers of the moquett-like accumulating surface 44. Since the endless belt having the accumulating surface 44 is being driven for horizontal movement by the motor 51, the weft Y is accumulated on the accumulating surface 44 in a regularly meandering line. The weft Y accumulated on the accumulating surface 44 is guided through the eyelet 10, the gripper 11 which alternately grips and releases the weft Y and a guide 10*a* to the main nozzle 12.

At a weft inserting phase, the main nozzle 12 jets air, and then the gripper 11 releases the weft Y immediately after the main nozzle 12 has jetted air. Then, the weft Y is pulled off continuously from the accumulating surface 44 and is inserted by the jet of air from the main nozzle 12. Then, the weft Y runs along a guide channel G formed in the modified reed 25. During a short period subsequent to the exhaustion of the weft Y accumulated on the accumulating surface 44, namely, during the period of the constrained running mode, the weft Y blown out from the accumulating nozzle 41 is guided directly to the main nozzle 12 and is inserted in to the warp shed as indicated by a broken line in FIG. 6. Upon completion of weft insertion, the gripper 11 grips the weft Y and, thereafter, the weft Y measured by the weft measuring roller 5 driven by the servomotor M is accumulated on the accumulating surface 44 in a regularly meandering line and is stored on the accumulating surface 44 until the next weft insertion.

It was found through experimental weaving operation that to coincide a moment when the surface speed of the weft measuring roller 5 reaches a maximum with a moment when the running mode of the weft Y changes from the free running mode to the constrained running mode, the rotating speed of the weft measuring roller 5 is to be controlled so that the surface speed of the same reaches a maximum at a phase of the crankshaft of the loom in the range of 190° to 245° when the weft inserting period corresponds to the range of 120° to 260° in the phase of the crankshaft.

The servomotor employed in the second embodiment for driving the weft measuring roller for variable-speed operation may be substituted by a pulse motor having satisfactory response characteristics.

Similarly to the method and apparatus for weft insertion in jet loom in the first embodiment according to the present invention, the method and apparatus for weft insertion in jet loom in the second embodiment diminishes the drop of the running speed of the inserted weft as measured at the exit of the main nozzle when the running mode of the weft changes from the free running mode to the constrained running mode, and thereby sudden increase of the weft tension is suppressed. Consequently, the problem of breaking or damaging the inserted weft when the running mode of the weft changes from the free running mode to the constrained running mode is solved, the drop in running speed of the inserted weft at the moment of the change of the running mode from the free running mode to the constrained running mode is suppressed and hence the possibility of faulty weft insertion is reduced. Furthermore, since the length of the weft drawn out during the weft inserting period is increased, the length of the weft to be accumulated during the accumulating period can be reduced accordingly. According to the present invention, the length of the weft to be accumulated during the accumulating period (a period corresponding to a period in which the crankshaft rotates through an angle of 220°) is 0.75 m, which is smaller by about 35% than a length of 1.15 m of the weft to be accumulated in the same period in the conventional weft inserting apparatus. Accordingly, the accumulating surface 44 of the present invention may be shorter than that of the conventional weft inserting apparatus and hence the weft storage unit III' requires less space for installation as compared with the conventional weft storage unit. The employment of the servomotor for driving the weft measuring roller enables the optional variation of the surface speed of the weft measuring roller. The surface speed of the weft measuring roller can be controlled in an optimum variable-speed control mode simply by properly setting the set values of the parameters by means of the speed setting unit. Thus, the weft inserting apparatus in the second embodiment requires less space for installing the weft storage unit than the weft inserting apparatus in the first embodiment having the driving unit employing the irregular formed gear, i.e., the elliptic gears, and enables the jet loom to operate at a higher weft inserting rate.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for weft insertion in a jet loom, comprising the steps of:

continuously drawing out a weft from a supply package;

temporarily accumulating and storing a predetermined length of the weft; and inserting the weft in a free running period in which the stored weft is inserted in a free running mode into a warp shed by a jet jetted by a main nozzle and in a subsequent constrained running period in which the weft drawn out from the supply package is inserted directly into the warp shed in a constrained running mode;

inserting the weft into the warp shed at a speed higher than a running speed Vf defined by $Vf=Lo/tc$, where Lo is the weft length and tc is a time period necessary for one weaving cycle of the loom during a period of a transient running mode in which the running mode of the inserted weft changes from the free running mode to the constrained running mode.

2. An apparatus for weft insertion in a jet loom, which draws out a weft continuously from a supply package, accumulates and stores temporarily a predetermined length of the weft, and inserts the weft in appropriate timing in a free running period in which the stored weft is inserted in a free running mode into a warp shed by a jet jetted by a main nozzle and in a subsequent constrained running period in which the weft drawn out from the supply package is inserted directly into the warp shed in a constrained running mode, said weft inserting apparatus comprising:

a weft measuring unit comprising a rotary member having a predetermined circumferential length and being rotated in synchronism with the crankshaft of the loom;

a weft storage unit for temporarily accumulating and storing the weft drawn out from the supply package by the weft measuring unit until the start of weft insertion; and a driving unit which drives the weft measuring unit so that the running speed of the inserted weft during a period of a transient running mode in which the running mode changes from the free running mode to the constrained running mode is higher than a speed Vf defined by: $Vf=Lo/tc$, where Lo is the weft length of the loom and tc is a time necessary for one weaving cycle of the loom.

3. An apparatus according to claim 2, wherein said weft measuring unit comprises a driving drum driven by a driving source of the loom and a weft measuring roller pressed against the driving drum for rotation, and said driving unit comprises a non-circular gear train including elliptic gears to drive the driving drum so that the surface speed of said weft measuring roller varies sinusoidally every one turn of said crankshaft of the loom in synchronism with the rotation of the crankshaft and the surface speed of the weft measuring roller reaches a maximum at a moment when the running mode of the inserted weft changes from the free running mode to the constrained running mode.

4. An apparatus according to claim 2, wherein said weft measuring unit comprises a weft measuring roller, and said driving unit comprises a variable-speed motor and a controller for controlling the variable speed motor to control the driving unit so that the surface speed of said weft measuring roller varies sinusoidally for every turn of said crankshaft of the loom in synchronism with the rotation of the crankshaft and the surface speed of the weft measuring roller reaches a maximum at a moment when the running mode of the inserted weft changes from the free running mode to the constrained running mode.

* * * * *